US005785580A

United States Patent [19]

Cook

[11] Patent Number: 5,785,580

[45] Date of Patent: Jul. 28, 1998

[54] COMPRESSION SLEEVE OPTHALMIC LENS CHUCK

[75] Inventor: Merritt S. Cook, Muskogee, Okla.

[73] Assignee: Coburn Optical Industries, Inc., Tulsa, Okla.

[21] Appl. No.: 729,650

[22] Filed: Oct. 21, 1996

Related U.S. Application Data

[62] Division of Ser. No. 341,525, Nov. 17, 1994, Pat. No. 5,567,198.

[51] Int. Cl.[6] ..... B24B 13/005

[52] U.S. Cl. ..... 451/42; 451/384; 451/460

[58] Field of Search ..... 451/43, 42, 389, 451/388, 384, 390, 460

[56] References Cited

U.S. PATENT DOCUMENTS

| | | | |
|---|---|---|---|
| 2,441,472 | 5/1948 | D'Avaucourt | 451/390 |
| 3,490,182 | 1/1970 | Lanman | 451/390 |
| 4,562,671 | 1/1986 | Bouillon et al. | 451/388 |
| 5,462,475 | 10/1995 | Kennedy | 451/384 |

FOREIGN PATENT DOCUMENTS

| | | | |
|---|---|---|---|
| 0035317 | 9/1981 | European Pat. Off. | 451/390 |
| 3121763 | 5/1991 | Japan | 451/456 |

*Primary Examiner*—Robert A. Rose
*Attorney, Agent, or Firm*—Frank J. Catalano; Scott P. Zingerman

[57] ABSTRACT

An ophthalmic lens block and lens generating machine compression sleeve chuck are provided such that the block is of diameter suitable for the lens edging step of the lens generating process. The lens generating chuck consists of a plurality of concentric sleeves mounted on a hub of the spindle shaft and having lengthwise slots permitting compression of the sleeve onto the hub and the block. The sleeves are biased to telescope toward the lens so as to abut the front surface of the lens in a concentric pattern extending outwardly from the outer diameter of the block to support the front surface of the lens against the forces applied to the rear face of the lens during the cutting process. Thus, the combination of the block and the chuck is also suitable for the lens generating, fining and polishing steps of the lens generating process. Consequently, after polishing, the block is left on the lens. The lens is inspected for power and quality through the hole in the block, which permits light to be projected through the lens. The lens is then edged, using the same block to connect the lens to the edging machine spindle. After edging, the block is then removed by a twisting motion to disengage it from the adhesive. The lens making process is thus completed using only a single block and with no need for liquification of alloys.

7 Claims, 4 Drawing Sheets

COMPRESSION SLEEVE OPTHALMIC LENS CHUCK

This is a divisional of copending application Ser. No. 08/341,525 filed on Nov. 17, 1994 now U.S. Pat. No. 5,567,198.

BACKGROUND OF THE INVENTION

This invention relates generally to equipment used in making ophthalmic lenses and more particularly concerns equipment used for blocking and chucking lenses for lens generating, fining, polishing and edging.

In known lens making processes, after selection of an appropriate lens blank for a given prescription, the blank is marked for blocking and protective tape is applied to its entire front surface. A block also covering the entire surface is then applied to the tape. To the extent that the contour of the front face of the lens blank differs from that of the block, gaps or voids will occur between the tape and the block. To square up the lens blank face, an alloy is pumped in liquid state into the gaps or voids. When cooled and solidified, the alloy provides rigidity to the lens. The blocked lens blank is mounted in a lens generator to generate the desired lens and transferred to a finer/polisher for polishing the lens surface. The block is removed after polishing by shocking the block to break its bond to the tape. The alloy is reheated to a liquid state and reclaimed. The cleaned lens is inspected for power and quality, and, if satisfactory reblocked for the edging step of the lens making process using a much smaller diameter block. Blocking for edging is generally accomplished by inserting a double sided adhesive pad between the block and the lens. After the lens has been edged, the block is removed by twisting the block to break the adhesion.

The above lens making process is relatively expensive and inefficient. Twice blocking the lens is a time consuming and tedious operation. Alloy injection is costly and time consuming. It necessitates additional equipment for heating and injecting the alloy into the void. It causes a delay in the process until the alloy has sufficiently cooled and solidified. The alloy reclamation process is also costly and time consuming, requiring the alloy to be reheated to liquification for collection. Additional equipment is also required for its reclamation from the lens. Moreover, the use of alloys in the process will likely be discontinued since some of them contain cadmium and lead, materials which may be banned by governmental agencies due to health considerations.

While it is desirable to eliminate the need for multiple blocking steps and the use of an alloy which must be liquified for injection and again liquified for retrieval, the lens making process complicates possible solutions to these problems. The lens generating, fining and polishing steps result in the application of forces to the face of the lens which may cause the lens to flex and distort. Consequently, the block and chuck used in these steps must sufficiently complement and support the surface of the lens so as to prevent this deflection or distortion. On the other hand, the block used in the lens edging step of the process must be sufficiently small so that the edging equipment will not come into contact with the block. This is why presently known lens edging blocks are significantly smaller than presently known lens generating blocks.

It is, therefore, an object of this invention to provide a single lens block suitable not only for the lens generating, fining and polishing steps but also for the lens edging step of the lens making process. Another object of this invention is to provide a lens block chuck which provides support for the front face of a lens against cutting forces applied to the lens as it is being generated, fined and polished. Another object of this invention is to provide a lens block and lens block chuck which, when used in combination permit the chuck spindle shaft to contact the lens surface and thus serve as a reference for lens center thickness control. It is also an object of this invention to provide a lens block having a through hole permitting lens power and quality inspection without removal of the block from the polished lens. Yet another object of this invention is to provide a lens block which can be secured to the lens by use of a quick curing or instant adhesive. Another object of this invention is to provide a lens block which facilitates use of one or more preformed or molded wafers to build up the front surface of the lens blank to an apparently spherical contour to which the block can be securely applied. And it is an object of this invention to provide a lens block which, in combination with one or more wafers inserted between the block and the chuck, distributes torsional stress over a greater area of the lens surface than is possible with the block alone.

SUMMARY OF THE INVENTION

In accordance with the invention, an ophthalmic lens block and compression sleeve chuck are provided. The block is of diameter suitable for the lens edging step of the lens generating process. The block has a through hole extending axially to the front surface of the lens so that the end of the spindle shaft projects through the block and touches a central portion of the lens and so that the central portion of the lens is visible to the eye when the blocked lens is removed from the spindle. The lens generating chuck consists of a plurality of concentric sleeves mounted on a hub of the spindle shaft and having lengthwise slots permitting compression of the sleeve onto the hub and the block. The leading edge of each sleeve is fitted with an O-ring or other suitable surface for contact with the lens and the sleeves are biased to telescope toward the lens so as to abut the front surface of the lens in a concentric pattern extending outwardly from the outer diameter of the block. Thus the concentric sleeves support the front surface of the lens against the forces applied to the rear face of the lens during the cutting process, so that the combination of the block and the chuck is suitable for the lens generating, fining and polishing steps of the lens generating process. The sleeves are compressed by the use of a concentric tapered closing sleeve surrounding the outermost compression sleeve having a lengthwise slot to permit compression of the closing sleeve. A concentric inversely tapered closing ring surrounding the closing sleeve is biased toward the lens so that, as the closing ring slides along the outer surface of the closing sleeve, the complementary tapers cause the closing sleeve to be compressed, thus sequentially compressing the compression sleeves to the hub and block. Biasing of the compression sleeves and the closing ring toward the lens may be accomplished by springs or use of compressed air. A concentric chuck opener surrounds the closing ring and engages with the closing ring as the opener moves away from the lens so that spring or air bias applied to the opener releases the sleeves and block from the hub when generating is completed. A pin extends diametrically through the closing sleeve, the compression sleeves, and the spindle shaft and engages with seats in the block to assure simultaneous rotation of these components with the shaft and to assure correct orientation of the blocking when inserted in the chuck. The concentric compression sleeves are longitudinally slotted to permit the sleeves to slide axially under the bias in relation to the pin.

In using the block and chuck described above, a spot of tape is applied to the lens blank surface and an instant adhesive applied to the block. Irregularities in the front face of the lens blank are squared up by use of one or more wafers or other build up, preferably secured to the front face of the lens blank by the same adhesive as applied to the block. The front face of the block is then secured to the tape or wafer. The rear of the block is connected to the compression sleeve chuck which provides the necessary additional support for the lens blank and the lens is generated, fined and polished. After polishing, the block is left on the lens. The lens is inspected for power and quality through the hole in the block, which permits light to be projected through the lens. The lens is then edged, using the same block to connect the lens to the edging machine spindle. After edging, the block is then removed by a twisting motion to disengage it from the adhesive. The lens making process is thus completed using only a single block and with no need for liquification of alloys.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
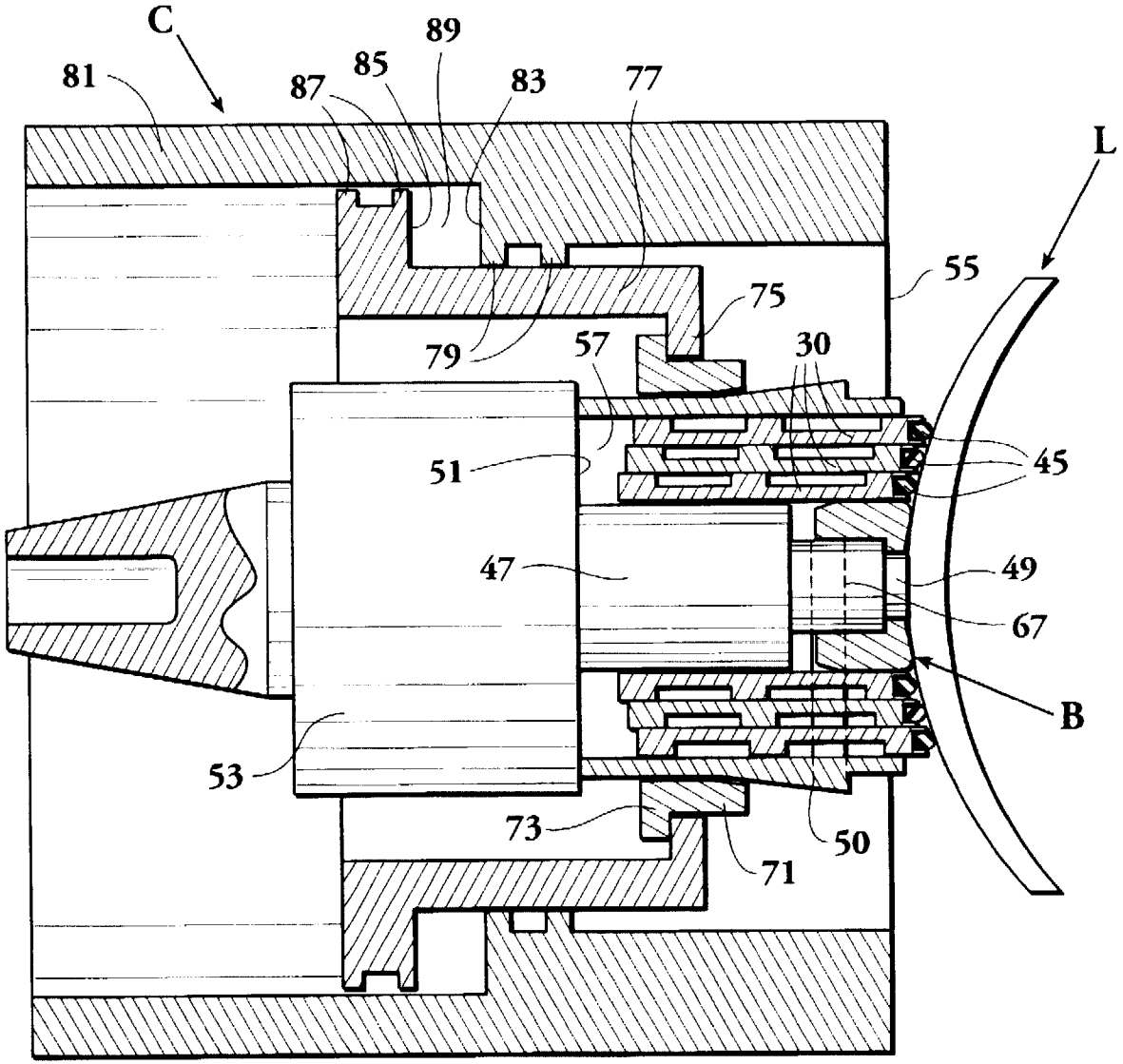
FIG. 1 is a diametric cross section illustrating a lens fixed to a preferred embodiment of the block which is mounted on a preferred embodiment of the compression sleeve chuck.

Turning first to FIG. 1, a preferred embodiment of a compression sleeve chuck C for use in conjunction with a preferred embodiment of a block B fixed to a lens blank L is illustrated.

Figure 2:
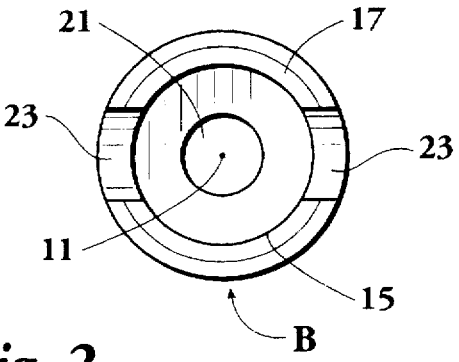
FIG. 2 is a front elevation view of the block of FIG. 1.
Figure 3:
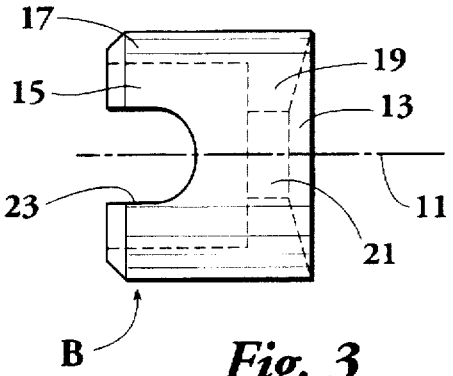
FIG. 3 is a side elevation view of the block of FIG. 1.
Figure 4:
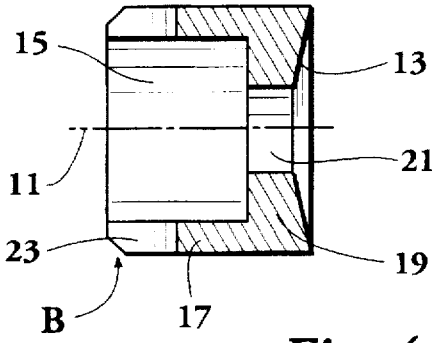
FIG. 4 is a diametric cross section of the block of FIG. 1.

As shown in FIGS. 2 through 4, the block B is a unitary body, preferably of plastic, formed or molded in symmetrical relationship to a rotational axis 11. The front face 13 of the block B is concavely tapered toward its center so as to provide a substantially conical blocking surface. The rear portion of the block B has an axially aligned cylindrical hollow 15 defining a relatively thin outer wall 17. A base 19 separates the hollow 15 and the concave blocking face 13. A cylindrical aperture 21 aligned on the rotational axis 11 extends through the base 19. A pair of diametrically opposed seats 23 in the outer wall 17 have semi-circular forward edges and open toward the rear of the block B.

Figure 6:
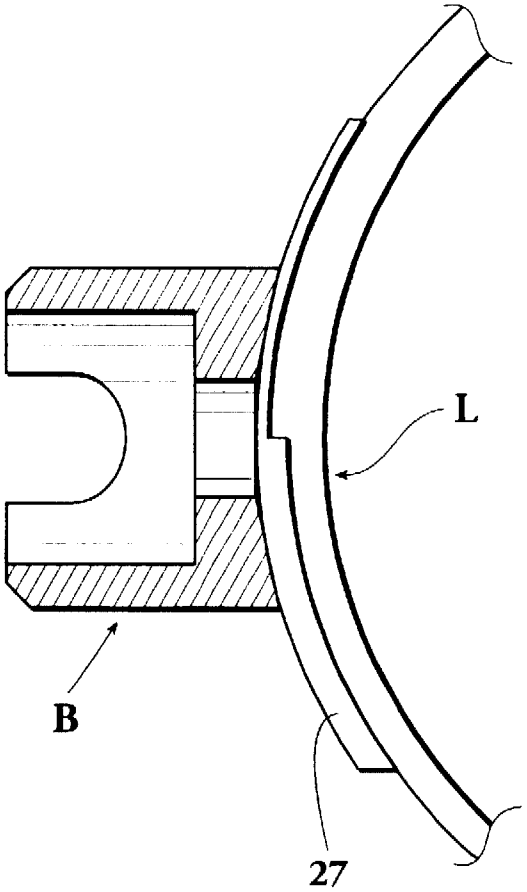
FIG. 6 is a side elevation view illustrating the completed lens-wafer-block assembly.
Figure 5:
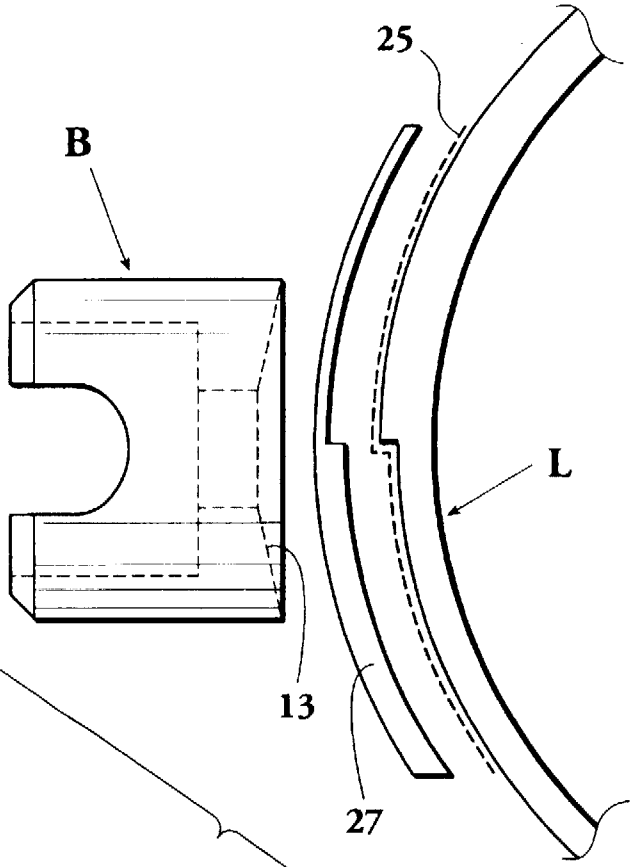
FIG. 5 is a side elevation view illustrating the application of a wafer to square up the lens surface for mounting of the block.
Figure 7:
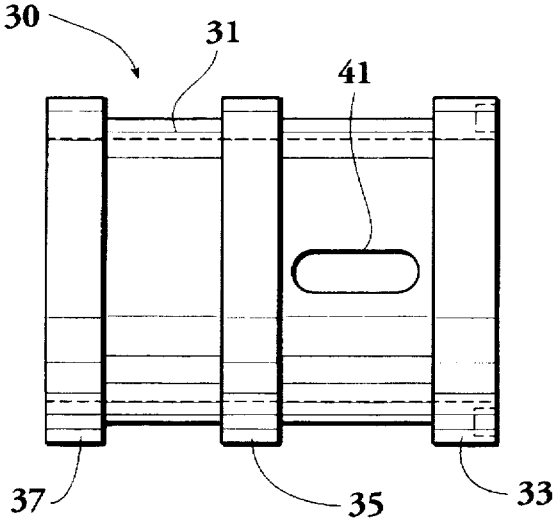
FIG. 7 is a top plan view of a preferred embodiment of a compression sleeve of the compression sleeve chuck of FIG. 1.
Figure 8:
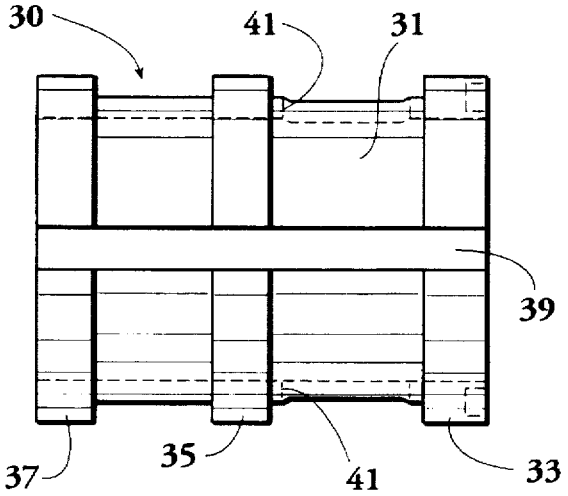
FIG. 8 is a side elevation view of the sleeve of FIG. 7.
Figure 9:
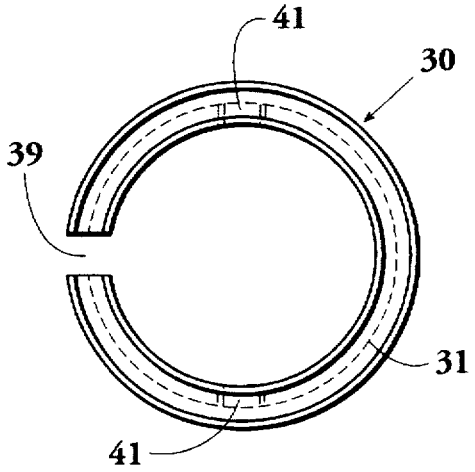
FIG. 9 is a front elevation view of the sleeve of FIG. 7.
Figure 10:
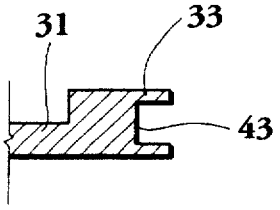
FIG. 10 is a radial cross section of the front rim of the sleeve of FIG. 7.

As shown in FIGS. 5 and 6, if the lens blank L has an irregular front surface, the front surface is squared up to receive the block B by the application of tape 25 to the lens blank L and the placement of a wafer 27 on the tape 25. The wafer 27 has a front face contoured to complement the front face of the lens blank L and a rear face of substantially spherical contour. The block B is adhered to the lens L or to the wafer 27 by the use of an automatic or instant adhesive (not shown) applied between the blocking face 13 of the block B and the convex spherical surface of either the wafer 27 or the lens blank L.

Turning now to FIGS. 7 through 10, a typical concentric telescoping compression sleeve 30 of the compression sleeve chuck C is illustrated. Each sleeve 30, preferably of bronze, consists of a cylindrical body 31 having front, intermediate and rear external annular ribs 33, 35 and 37. A slit 39 extends the length of the body 31 so that the diameter of the body 31 can be varied. A pair of diametrically opposed slots 41 are also provided longitudinally in the body 31 between the front and intermediate ribs 33 and 35. As can best be seen in FIG. 10, the front rib 33 is provided with an annular groove 43 in its front face for supporting an O-ring 45, best seen in FIG. 1. Preferably, the O-rings 45 will be of hard rubber, though brass, bronze, plastic or other suitable material could also be used. As can best be seen in FIG. 1, the innermost compression sleeve 30 will have an inner diameter such that it can be compressed to simultaneously grip the hub 47 of the chuck C and the block B. Each outwardly consecutive compression sleeve 30 is of diameter such that it can be compressed against the ribs 31, 33 and 35 of the next inwardly oriented compression sleeve 30.

Figure 11:
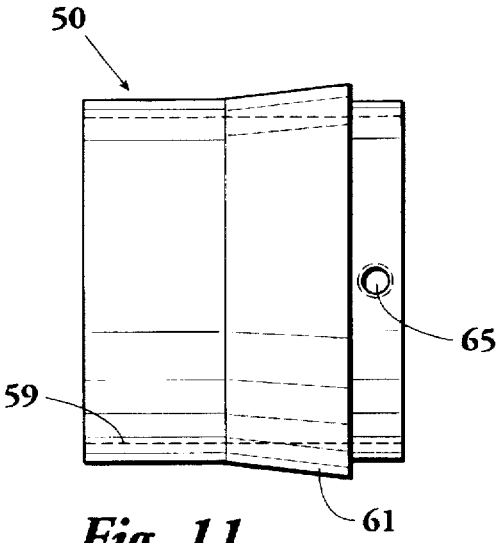
FIG. 11 is a top plan view of a preferred embodiment of a closing sleeve of the compression sleeve chuck of FIG. 1.
Figure 12:
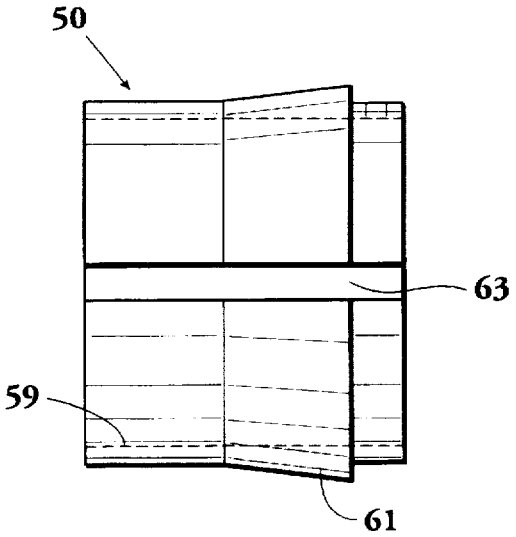
FIG. 12 is a side elevation view of the closing sleeve of FIG. 11.
Figure 13:
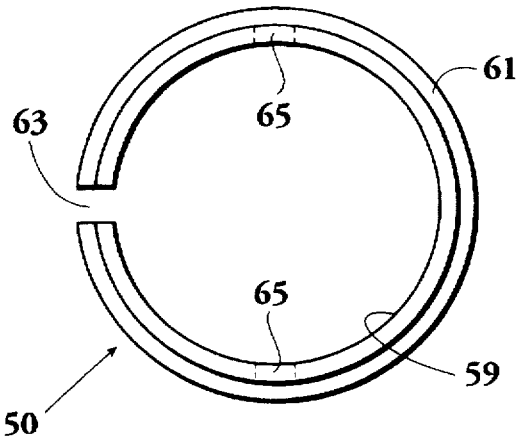
FIG. 13 is a front elevation view of the closing sleeve of FIG. 11.

As shown in FIG. 1, the outermost compression sleeve 30 lies within a concentric outer or closing sleeve 50 which extends from a front wall 51 of the chuck body 53 through the front face 55 of the chuck C. Thus, the front wall 51 of the chuck body 53, the cylindrical wall of the hub 47, the inside surface of the closing sleeve 50 and the rear portions of the compression sleeves 30 define an annular air pocket 57 for purposes hereinafter explained. Looking at FIGS. 11 through 13, the closing sleeve 50 has a cylindrical side wall 59 tapered outwardly at the intermediate portion thereof to provide a minimal outer diameter at the rear of the intermediate portion 61 and a maximum outer diameter at the front of the intermediate portion 61. A length long slit 63 permits the diameter of the closing sleeve 50 to be varied. Diametrically opposed apertures 65 are provided proximate the front of the closing sleeve 50 through the side wall 59. Preferably, the slit 63 is centered between the apertures 65. A pin 67 extends diametrically snugly through the apertures 65 in the closing sleeve 50, the slots 41 in the compression sleeves 30 and the spindle 49 of the chuck C. The pin 67 is also snugly seated in the seats 23 of the block B. Thus, the pin 67 aligns the closing sleeve 50, the concentric compression sleeves 30, the spindle 49 and the block B for rotation in unison while the slots 41 allow the sleeves 30 to slide longitudinally in relation to the pin 67. Looking again at FIG. 1, a closing ring 71 is concentrically fitted about the closing sleeve 50 and the forward portion of the closing ring 71 is outwardly tapered to complement the contour of the tapered intermediate portion 61 of the closing sleeve 50. A rear flange 73 on the closing ring 71 is engagable with a forward flange 75 of a concentric chuck opener 77 which rides on bearings 79 annularly extending on the inside wall of a chuck opener mount 81 encasing the components of the chuck C. The interior surface of the chuck opener mount 81 has a vertical portion 83 opposed to a flange 85 on the rear portion of the chuck opener 77. The flange has annular bearings 87 riding on the inner wall of the chuck opener mount 81 so that the flange 85, the vertical wall 83 and the cylindrical walls of the chuck opener 77 and the chuck opener mount 81 define an air pocket 89 for purposes hereinafter explained.

In operation, the lens blank L to be finished, is taped only where contact is to be made with the block B. If necessary, an appropriate complementary wafer 27 is applied to the front face of the lens blank L or tape 25 by use of a preferably instant adhesive to square up the surface for blocking. The block B is secured to the squared-up lens blank L, preferably also by the use of an instant adhesive. The block is mounted on the compression sleeve chuck C by inserting the chuck spindle 49 into the hollow 15 of the block B until the front face of the spindle 49 contacts the apex of the lens blank L. It should be specially noted that, in this arrangement, the face of the spindle 49 is in contact with the lens blank L and, therefore, can be used as a lens center thickness reference. This is preferred to the use of the block as a reference, hitherto required because presently known blocks completely separate the lens blank L from the face of the spindle 49. In mounting the block B on the spindle 49, the pin 67 is snugly seated in the seats 23 provided in the block B, thus aligning the lens blank L in a desired reference condition. With the block B so mounted, air is injected into the pocket 57 between the chuck body 53, the compression sleeves 30 and the closing sleeve 50. This causes the compression sleeves 30 to telescope forwardly until their respective O-rings 45 come into contact with the front face of the lens blank L. The closing ring 71 is then forwardly driven, preferably also by air pressure, so that the complementary tapers on the closing ring 71 and the closing sleeve 50 compress the closing sleeve 50 by closing the slit 63 in the closing sleeve 50. As the closing sleeve diameter decreases, the compression sleeves 30 are sequentially compressed, reducing their respective diameters as the slits 39 in the sleeves 30 are closed. Thus, the O-rings 45 are biased against the front face of the lens blank L, and are secured in that position by the sequential compression of the sleeves 30 to each other until the innermost sleeve is compressed to the hub 47 and to the block B. The telescoped arrangement of O-rings 45 against the lens blank L provides the necessary support to counter the forces exerted on the lens blank L during the lens generating, fining and polishing steps. When the work is completed, the introduction of air into the pocket 89 between the chuck opener 77 and the chuck opener mount 81 causes the chuck opener 77 to move rearwardly in the chuck C, drawing the closing ring 71 rearwardly in relation to the closing sleeve 50 when their respective flanges 73 and 75 become engaged. This releases the compressive force on the closing sleeve 50 and the compression sleeves 30 so that the block B can be removed from the chuck C. It should be noted that torque is applied to the block B during the rotational operation of the device because of the engagement of the pin 67 with the closing sleeve 50, the compression sleeves 30, the spindle 49 and the block B and also because of the impressive forces exerted from the closing ring 71 to the hub 47 and the block B through the closing sleeve 50 and the compression sleeves 30.

The device has been described as an air actuated system for biasing the compression sleeves toward the lens blank L, for biasing the closing ring 71 toward the lens blank L and for biasing the chuck opener 77 away from the lens blank L. Biasing may alternatively be accomplished by the use of springs or other resilient means suitable to the purpose.

Thus, it is apparent that there has been provided, in accordance with the invention, a compression sleeve ophthalmic lens chuck that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A method of making an ophthalmic lens from a lens blank comprising the steps of:

applying a spot of tape adhesively to a small center portion of a front face of said lens blank;

adhering a block of diameter substantially less than a diameter of said lens blank to said tape;

mounting said block with said lens blank thereon for rotation on a chuck of a lens generating machine; and driving a sleeve of said chuck over said block, said sleeve providing support against said front face of said lens blank outwardly of said block to counter forces applied to a rear face of said lens blank during operation of said lens generating machine.

2. A method according to claim 1 further comprising the steps of:

generating said lens in said lens generating machine;

transferring said generated lens to a fining/polishing machine without removing or altering said block;

fining and polishing said transferred lens;

removing said polished lens with said block from said fining/polishing machine; and inspecting said polished lens for power and quality through an aperture provided in said block extending axially to a center of said lens.

3. A method according to claim 2 further comprising the steps of:

mounting said block with said inspected lens thereon for rotation on a chuck of a lens edging machine;

edging said chucked lens;

removing said edged lens and said block from said edging machine; and removing said block from said edged lens.

4. A method according to claim 1, said step of mounting said block with said lens blank thereon for rotation on a chuck of a lens generating machine further comprising the substep of inserting a spindle shaft of said chuck into an aperture provided in said block extending axially to a center of said lens blank until a front face of said shaft abuts said front face of said lens blank so as to provide a lens thickness reference for said lens generating machine.

5. A method according to claim 1, said step of applying a spot of tape adhesively to a small center portion of a front face of said lens blank further comprising the substep of adhering a preformed wafer to said front face of said lens blank to square up irregularities in said front face prior to adhering of said block thereto.

6. A method according to claim 1 further comprising the step of driving a second sleeve of said chuck over said first sleeve, said second sleeve providing support against said first face of said lens blank outwardly of said first sleeve to counter forces applied to a rear face of said lens blank during operation of said lens generating machine.

7. A method according to claim 1 further comprising the step of driving a plurality of concentric sleeves of said chuck over said block, said concentric sleeves providing support against said first face of said lens blank outwardly of said block and of more inwardly positioned ones of said sleeves to counter forces applied to a rear face of said lens blank during operation of said lens generating machine.

* * * * *